US007195225B1

(12) United States Patent
Holliday

(10) Patent No.: US 7,195,225 B1
(45) Date of Patent: Mar. 27, 2007

(54) ROTARY VALVE ASSEMBLY

(75) Inventor: David Holliday, Spring, TX (US)

(73) Assignee: Dril-Quip, Inc., Houston, TX (US)

( * ) Notice: Subject to any disclaimer, the term of this patent is extended or adjusted under 35 U.S.C. 154(b) by 103 days.

(21) Appl. No.: 10/978,742

(22) Filed: Nov. 1, 2004

Related U.S. Application Data

(60) Provisional application No. 60/515,766, filed on Oct. 30, 2003.

(51) Int. Cl.
*F16K 31/00* (2006.01)

(52) U.S. Cl. ..... 251/63.05; 251/62; 251/309; 251/313

(58) Field of Classification Search ..... 251/63.5, 251/63.6
See application file for complete search history.

(56) References Cited

U.S. PATENT DOCUMENTS

| | | | | | |
|---|---|---|---|---|---|
| 3,497,004 | A | * | 2/1970 | Page, Jr. | 166/322 |
| 4,071,088 | A | * | 1/1978 | Mott | 166/375 |
| 4,113,231 | A | | 9/1978 | Halpine | |
| 4,147,327 | A | | 4/1979 | Moran | |
| 4,149,698 | A | * | 4/1979 | Deaton | 251/63.6 |
| 4,167,262 | A | * | 9/1979 | Lemmon | 251/25 |
| 4,254,793 | A | | 3/1981 | Scaramucci | |
| 4,317,490 | A | | 3/1982 | Milberger et al. | |
| 4,386,756 | A | | 6/1983 | Muchow | |
| 4,406,442 | A | * | 9/1983 | Bettin et al. | 251/310 |
| 4,415,037 | A | | 11/1983 | Brooks | |
| 4,589,493 | A | | 5/1986 | Kelly et al. | |
| 4,815,700 | A | | 3/1989 | Mohrfeld | |
| 4,848,472 | A | | 7/1989 | Hopper | |
| 4,848,473 | A | | 7/1989 | Lochte | |
| 4,899,980 | A | | 2/1990 | Kemp | |
| 4,911,408 | A | | 3/1990 | Kemp | |
| 5,010,956 | A | | 4/1991 | Bednar | |
| 5,313,979 | A | | 5/1994 | Wang | |
| 5,338,001 | A | | 8/1994 | Godfrey et al. | |
| 5,551,665 | A | | 9/1996 | Noack et al. | |
| 5,575,336 | A | | 11/1996 | Morgan | |
| 5,575,363 | A | | 11/1996 | Dehrmann et al. | |
| 6,176,316 | B1 | | 1/2001 | Hart | |
| 6,293,513 | B1 | | 9/2001 | Birkelund | |
| 6,453,944 | B2 | | 9/2002 | Bartlett | |
| 6,497,277 | B2 | | 12/2002 | Cunningham et al. | |
| 6,520,207 | B2 | | 2/2003 | Bartlett et al. | |
| 6,609,532 | B1 | | 8/2003 | Peterson | |
| 2001/0042618 | A1 | | 11/2001 | Cunningham et al. | |
| 2003/0141072 | A1 | | 7/2003 | Cove et al. | |

FOREIGN PATENT DOCUMENTS

| | | |
|---|---|---|
| GB | 2358207 | 7/2001 |
| WO | WO 00/15943 | 3/2000 |
| WO | WO 01/53654 | 7/2001 |

* cited by examiner

*Primary Examiner*—J. Casimer Jacyna
(74) *Attorney, Agent, or Firm*—Baker Botts L.L.P.; Paul R. Morico

(57) ABSTRACT

The present invention is directed to rotary valve assemblies and, more particularly, to a rotary valve assembly for use in an oil and gas production system. The valve assembly comprises a movable actuator sleeve movable in response to hydraulic pressure and at least one seat, the at least one seat having at least one fluid channel capable of providing fluid flow therethrough. The valve assembly also comprises a rotating disk disposed between the at least one seat and a support bushing, the rotating disk capable of rotating in response to movement of the movable actuator sleeve, the rotating disk having an open position and a closed position, wherein the open position permits fluid flow through the at least one fluid channel of the at least one seat and the closed position stops fluid flow through the at least one fluid channel of the at least one seat.

20 Claims, 10 Drawing Sheets

ROTARY VALVE ASSEMBLY

RELATED APPLICATION

This application claims the benefit of U.S. Provisional Patent Application Ser. No. 60/515,766, filed Oct. 30, 2003, which is herein incorporated by reference in its entirely as if set forth below.

FIELD OF THE INVENTION

The present invention is related to rotary valve assemblies and, more particularly, to a rotary valve assembly for use in an oil and gas production system.

BACKGROUND OF THE INVENTION

When a subsea well is completed, it is important to be able to monitor the annulus cavity between the tubing and the innermost casing string for leaks and yet also to be able to shut in the annulus cavity, if needed. One method to accomplish this is to provide a second vertical throughbore to the tubing hanger and change the single bore subsea tree to a dual bore subsea tree. This approach may be expensive since the cost of the subsea tree increases significantly and a second riser string needs to be run with the hanger and the tree.

Another way to accomplish this is to put a valve to the hanger, thereby reducing the cost of the dual tree to that of a single bore tree. There have been various hanger valves designed in the past, including annulus valves and small bore gate valves. These valves are of limited use in that a long life, conventional metal-to-metal seal is problematic. Moreover, this approach typically restricts the gate valve flow bore diameter to 1" and greatly increases the hanger length. The disadvantages of the prior art are overcome by the present invention, as described in more detail below.

Prior patents include U.S. Pat. Nos. 6,729,392, 6,453,944, 6,626,239, 6,520,207 and 6,497,277. The '944 patent discloses a gate valve assembly with an actuator for moving gates simultaneously. The '277 patent discloses a gate valve with a return housing mechanism.

SUMMARY

The present invention is directed to a rotary valve assembly for use in an oil and gas production system that overcomes or at least minimizes some of the drawbacks of the prior art described above. The disadvantages of the prior art are overcome by the present invention, and an improved and relatively compact rotary valve assembly is hereinafter disclosed which has particular utility in an oil and gas production system.

In general, in one aspect, the present invention features a rotary valve assembly. The rotary valve assembly comprises a movable actuator sleeve movable in response to hydraulic pressure and at least one seat, the at least one seat having at least one fluid channel capable of providing fluid flow therethrough. The rotary valve assembly also comprises a rotating disk disposed between the at least one seat and a support bushing, the rotating disk capable of rotating in response to movement of the movable actuator sleeve, the rotating disk having an open position and a closed position, wherein the open position permits fluid flow through the at least one fluid channel of the at least one seat and the closed position stops fluid flow through the at least one fluid channel of the at least one seat.

In general, in another aspect, the present invention features a rotary valve assembly that may comprise a movable actuator sleeve, first and second seats, and a rotating disk. A pressure port may provide access for a hydraulic fluid to establish a hydraulic pressure. The movable actuator sleeve may move in response to the hydraulic pressure. The first and second seats may include a fluid channel that provides for fluid flow. The rotating disk may be disposed between the first and second seats. Movement of the movable actuator sleeve may cause the rotating disk to rotate to an open or a closed position. When in an opened position, the rotating disk permits fluid flow between the fluid channels of the first and second seats. In the closed position, the rotating disk stops fluid flow between the first and second seats.

BRIEF DESCRIPTION OF THE DRAWINGS

A complete understanding of the present disclosure and advantages thereof may be acquired by referring to the following description taken in conjunction with the accompanying drawings, in which the leftmost significant digit(s) in the reference numerals denote(s) the first figure in which the respective reference numerals appear, wherein:

FIG. 2AA schematically illustrates a key hole slot in a movable actuator sleeve;

FIG. 2AB schematically illustrates a sectional view of a rotary valve assembly having a modified rotating disk and a support bushing;

FIG. 2BB schematically illustrates a sectional view of a rotary valve assembly having a modified rotating disk and a support bushing;

Figure 1:
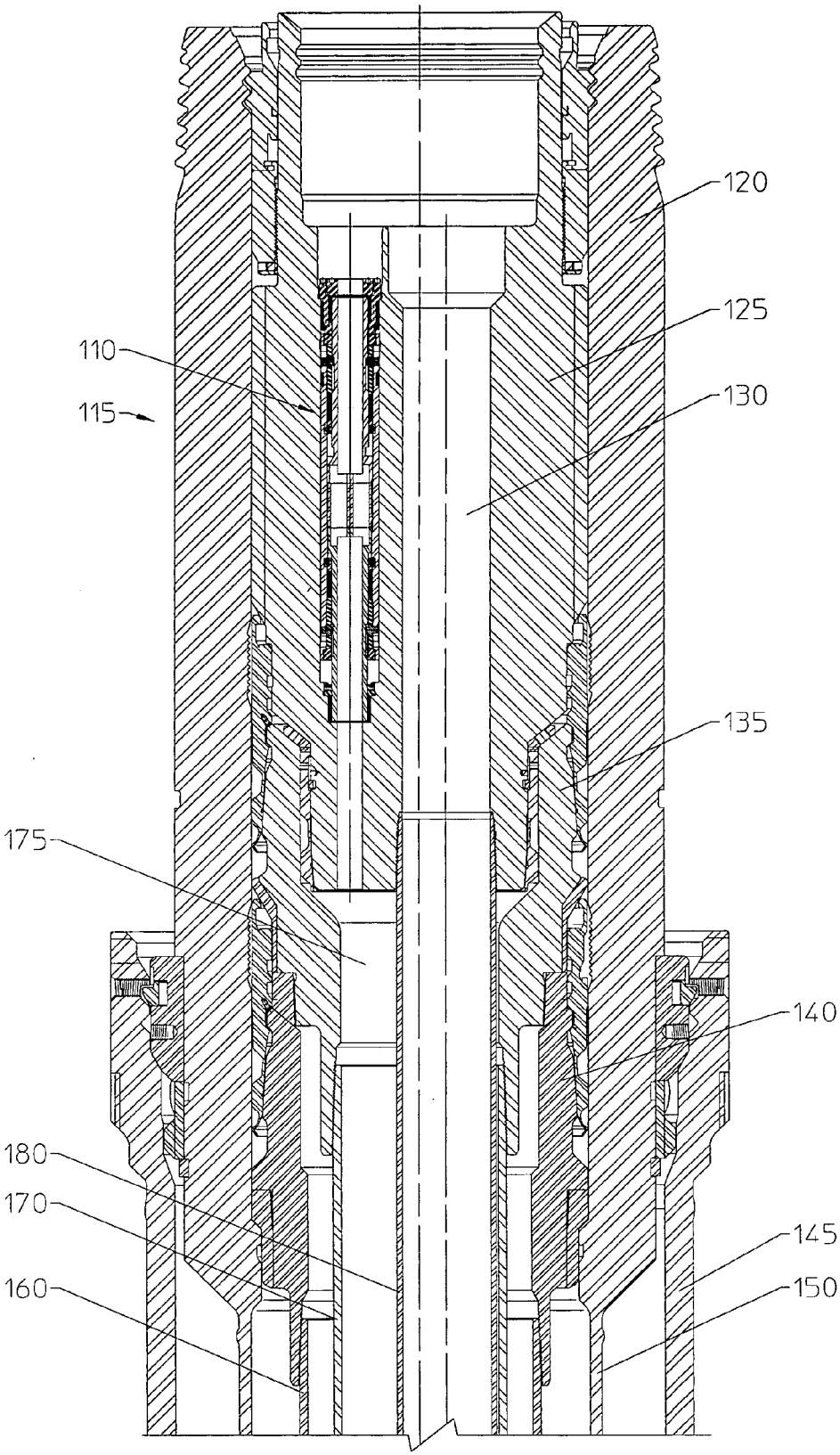
FIG. 1 schematically illustrates an example of a rotary valve assembly in a dual bore hanger assembly.

While the present invention is susceptible to various modifications and alternative forms, specific exemplary embodiments thereof have been shown by way of example in the drawings and are herein described in detail. It should be understood, however, that the description herein of specific embodiments is not intended to limit the present invention to the particular forms disclosed, but, on the contrary, the present intention is to cover all modifications, equivalents, and/or alternatives that fall within the spirit and scope of the present invention as defined by the appended claims.

DETAILED DESCRIPTION

Illustrative embodiments of the present invention are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The details of various illustrative embodiments of the present invention will now be described with reference to the figures. Turning to FIG. 1, a rotary valve assembly 110 is shown in a dual bore tubing hanger assembly 125. The tubing hanger 125 provides a means to seal a flow bore 130 to tubing 180 and to an inner casing hanger 135 that seals off to an outer casing hanger 140 that seals off to a wellhead 120 that sits on a conductor 145. Casings 170, 160 and 150 are connected to the bottom of the respective casing hanger 135, casing hanger 140 and wellhead 120. An annulus cavity 175 is formed by the inner casing 170, the casing hanger 135, the tubing hanger 125, the tubing 180 and a sealing means (not shown) between the tubing 180 and the casing 170 located below the wellhead 120. The components described are used in the configuration described to create a wellhead assembly 115 from which fluids and/or gases may be removed and/or placed in the earth.

The rotary valve assembly in accordance with the present invention is shown generally by reference numeral 110. The annulus cavity 175 needs to be sealed so that the annulus cavity 175 can contain pressure. Sometimes it is desirable to have access to the annulus cavity 175. For example, it may be desirable to see if pressure is present in the annulus cavity 175. The annulus cavity 175 may be pressurized by a leak in the tubing 180, possibly caused by corrosion, so that the fluid that is in the flow bore 130 is able to reach into the annulus cavity 175. When it is necessary to have access to the annulus cavity 175, the rotary valve assembly 110 can be opened. When it is necessary to have annulus cavity 175 sealed, the rotary valve assembly 110 can be closed.

Figure 2A:
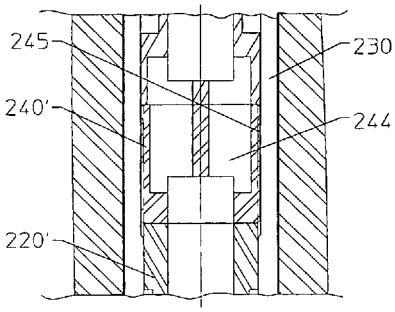
FIG. 2A schematically illustrates a sectional view of a rotary valve assembly in the open position with the depicted components positioned within a valve body.
Figure 2A:
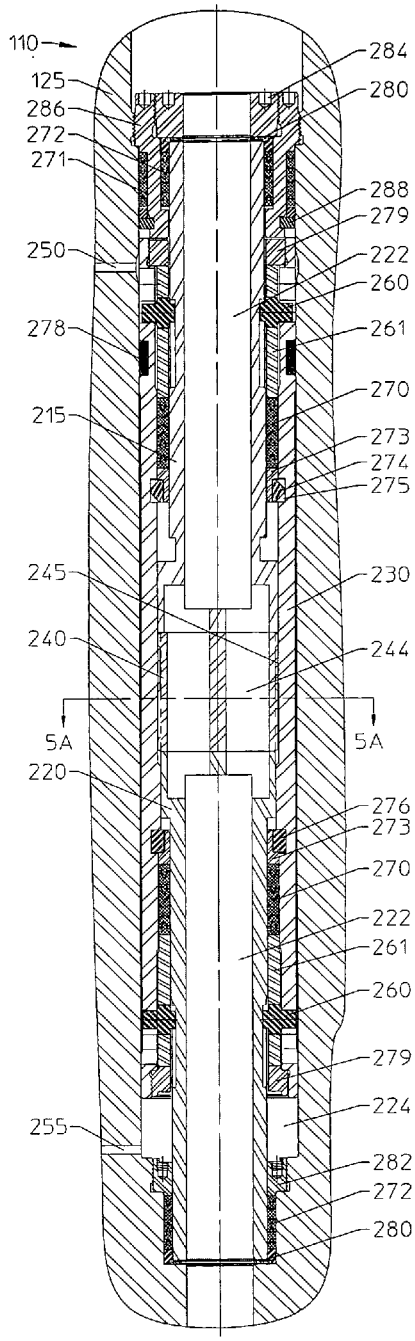
Figure 2A:
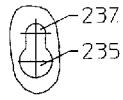

Turning to FIG. 2A, one embodiment of the rotary valve assembly 110 comprises a movable actuator sleeve 230, an upper seat 215, a lower seat 220, and a rotating disk 240 disposed between the upper seat 215 and the lower seat 220. Both the upper seat 215 and the lower seat 220 include a fluid channel and/or a fluid chamber and/or a fluid passageway 222. A pressure port 250 is connected to cavity 226 (see, for example, FIG. 2B) formed by the tubing hanger body 125 on the outer diameter, the upper seat 215 on the inner diameter, a seal or packing gland 286 on the top, and the actuator sleeve 230 on the bottom. Seals 270, 271, 272 and 278 contain the pressure between the respective components. Seal nut 284, split ring 288, seal nut 279, retainer 261, ring 273, split ring 282, split ring 276, and split ring 274 are used to retain the various seals. Pressure applied to the pressure port 250 will fill cavity 226, which will cause the actuator sleeve 230 to move downwards until the actuator sleeve 230 bottoms out on a shoulder of the tubing hanger body 125, as the actuator sleeve 230 will behave like a piston. Pressure port 255 is connected to cavity 224 (see, for example, FIG. 2A) formed by the tubing hanger body 125 on the outer diameter and bottom, the lower seat 220 on the inner diameter, and the actuator sleeve 230 on the top. The seals 270, 272 and 278 contain the pressure between the respective components. Pressure applied to the pressure port 255 will fill cavity 224, which will cause the actuator sleeve 230 to move upwards until the actuator sleeve 230 tops out on the seal or packing gland 286, as the actuator sleeve 230 will continue behaving like a piston.

In various illustrative embodiments, movement of the movable actuator sleeve 230 may be controlled by pressure created by hydraulic fluid that is introduced into the pressure port 250, for example. Hydraulic pressure causes the movable actuator sleeve 230, but neither the upper seat 215 nor the lower seat 220 to move. Consequently, the movable actuator sleeve 230 may move relative to both the upper seat 215 and the lower seat 220.

In various illustrative alternative embodiments, the rotary valve assembly 110 may comprise the movable actuator sleeve 230 and either the upper seat 215 alone or the lower seat 220 alone when used with a modified rotating disk 240' and a support bushing 220', as shown, for example, in FIGS. 2AB and 2BB. FIGS. 2AB and 2BB show the modified rotating disk 240' replacing the rotating disk 240 shown in FIGS. 2A and 2B, for example. FIGS. 2AB and 2BB also show the support bushing 220' replacing the lower seat 220 shown in FIGS. 2A and 2B, for example.

In various illustrative embodiments, the rotating disk 240 is disposed between the upper seat 215 and the lower seat 220. The exterior of the rotating disk 240 includes a male thread pattern 342 (as shown, for example, in FIG. 3A), and a portion of the movable actuator sleeve 230 adjacent to the rotating disk 240 includes a mating female thread pattern 245. Longitudinal movement of the rotating disk 240 is prevented by the upper seat 215 and the lower seat 220. Thus, movement of the movable actuator sleeve 230 causes the rotating disk 240 to rotate axially. In this fashion, the pressure at the pressure port 250 and/or the pressure port 255 controls movement of the movable actuator sleeve 230, which, in turn, controls the rotation of the rotating disk 240.

The upper seat 215 and the lower seat 220 are held in rotational orientation to the movable actuator sleeve 230 by orientation pins 260. The inner end of the orientation pins 260 may be located in grooves in the upper seat 215 and the lower seat 220, and in a key hole slot 235, as shown in FIG. 2AA, for example, in the movable actuator sleeve 230, which allow the movable actuator sleeve 230 to move vertically with respect to the upper seat 215 and the lower seat 220 but prevent the upper seat 215 and the lower seat 220 from rotating in the movable actuator sleeve 230. The orientation pin 260 is maintained in the key hole groove 235 in the movable actuator sleeve 230 with a retainer 261. The orientation pin 260 is prevented from rubbing the wall of the tubing hanger body 125 by a flange (not shown) on the outer diameter of the orientation pin 260 contacting a slot 237 of the key hole groove 235. The upper seat 215 and the lower seat 220 maintain a proper orientation with one another while the rotating disk 240 rotates. Consequently, the upper seat 215 and the lower seat 220 maintain a fixed and/or static relationship with one another while the rotating disk 240 rotates. The rotary valve assembly 110 may include seals 278, 271, 272, and 270.

Figure 3A:
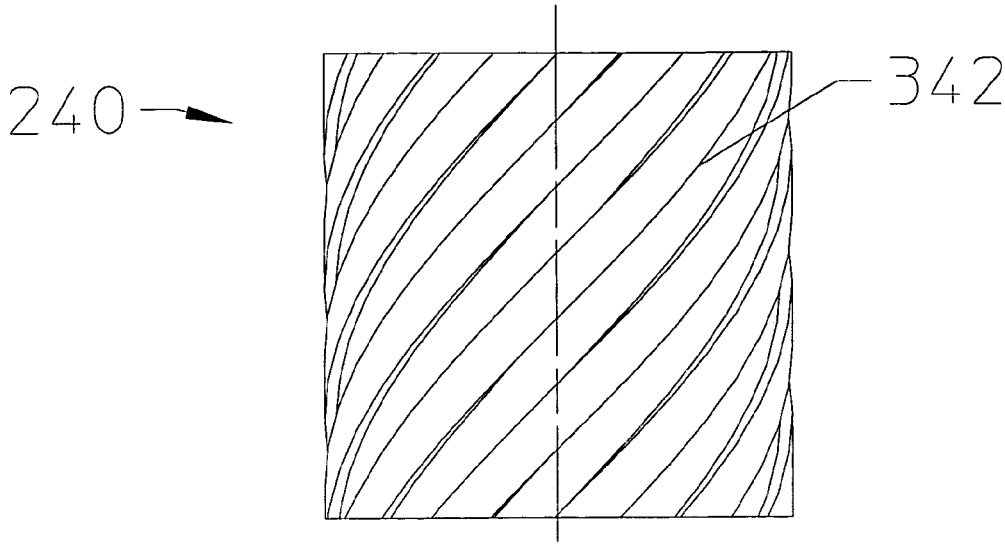
FIG. 3A schematically illustrates a side view of a rotating disk showing the male threads on the rotating disk.
Figure 3B:
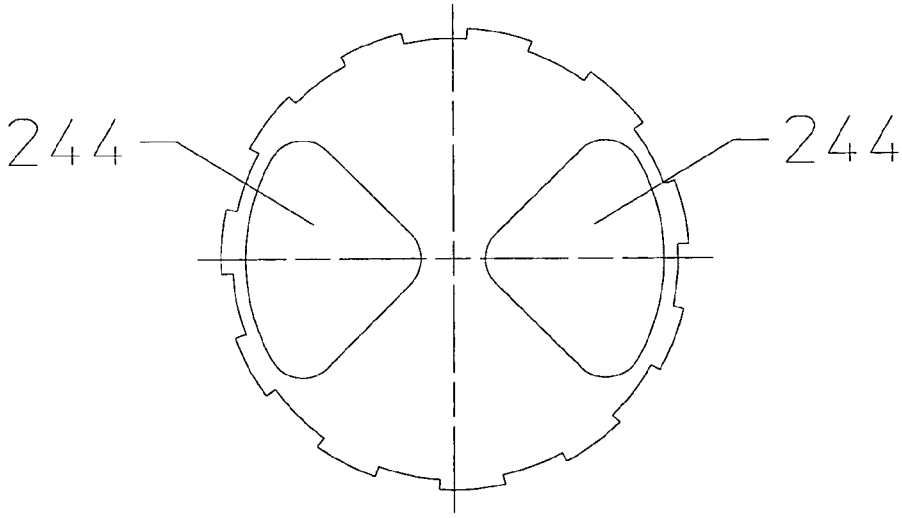
FIG. 3B schematically illustrates an end view of the rotating disk shown in FIG. 3A.

FIGS. 3A and 3B show various illustrative embodiments of the rotating disk 240. A side view of the rotating disk 240 is shown in FIG. 3A. An exterior surface of the rotating disk 240 includes the male threads 342. An interior surface of the movable actuator sleeve 230 that is adjacent to the rotating disk 240 includes the female threads 245. The male threads 342 may be mated to the female threads 245 located on the movable actuator sleeve 230. Through this male thread 342/female thread 245 interaction, rotation of the rotating disk 240 may be controlled by movement of the movable actuator sleeve 230. A top view of the rotating disk 240 is shown in FIG. 3B. In various illustrative embodiments, the rotating disk 240 includes two substantially triangular or substantially pie-shaped fluid channels 244. The fluid channels 244 are shaped to maximize the flow area. In various alternative illustrative embodiments, the rotating disk 240 may include one or more substantially round or other appropriately shaped fluid channels 244. As will be discussed in more detail below, the open and closed positions of the rotary valve assembly 110 depend on the axial position of the fluid channels 244.

Figure 4A:
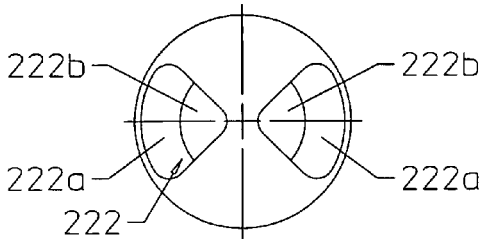
FIG. 4A schematically illustrates an end view of a seat.
Figure 4B:
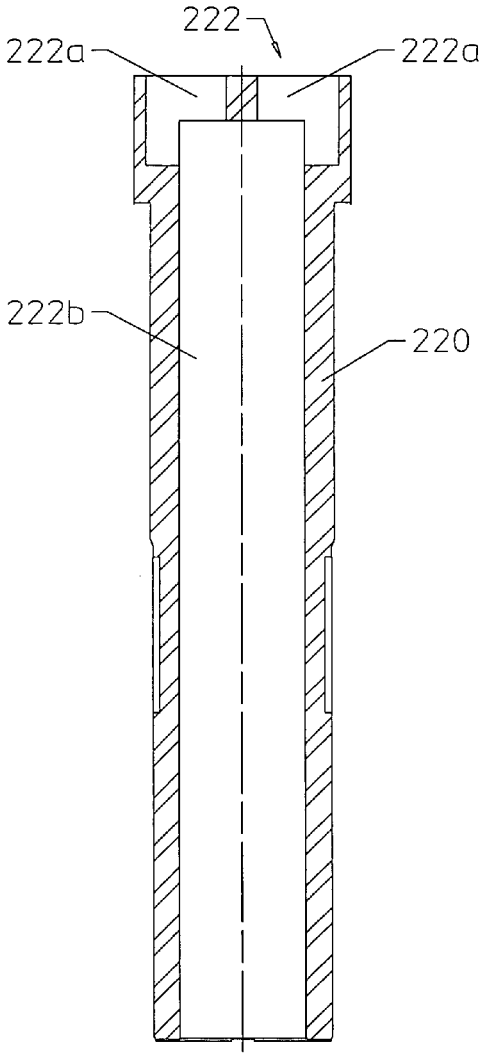
FIG. 4B schematically illustrates a sectional view of a lower seat.
Figure 4C:
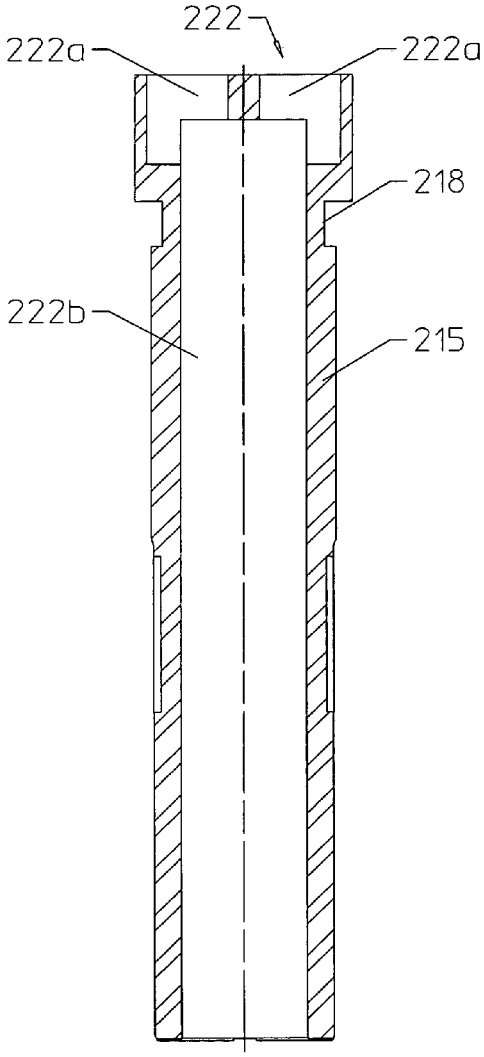
FIG. 4C schematically illustrates a sectional view of an upper seat.

The upper seat 215 is shown in FIG. 4C and the lower seat 220 is shown in FIG. 4B. An end view of the upper seat 215 or the lower seat 220 is shown in FIG. 4A. A longitudinal section of the lower seat 220 is shown in FIG. 4B and a longitudinal section of the upper seat 215 is shown in FIG. 4C. The upper seat 215 and the lower seat 220 include the fluid channels 222. The fluid channel 222 includes two substantially triangular or substantially pie-shaped fluid channels 222*a* located at one end of the upper seat 215 and/or the lower seat 220 (as shown in FIGS. 4A, 4B and 4C, for example) and a fluid channel 222*b* that extends through the central bore of each of the upper seat 215 and/or the lower seat 220 seat, as shown in FIGS. 4B and 4C, for example. In various alternative illustrative embodiments, the fluid channel 222 may include one or more substantially round or other appropriately shaped fluid channels 222*a*.

The upper seat 215 is substantially identical to the lower seat 220 except that the upper seat 215 has a groove 218. The groove 218 is included so that the split ring 274 could be installed into a groove 275 on the inner surface of the movable actuator sleeve 230, as shown in FIG. 2A. The split ring 274 along with the ring 273 retains the seal 270 from moving downward with respect to the movable actuator sleeve 230. The lower seat 220 does not need a groove similar to the groove 218 because the assembly procedure of the movable actuator sleeve 230 allows for the lower seal 270 to be installed prior to the assembly of the lower seat 220. As the movable actuator sleeve 230 is assembled, the upper seat 215 is installed prior to the seat-to-sleeve seal 270 and the split ring 274. In order to install the split ring 274, the split ring 274 is placed in the upper seat groove 218 in a collapsed condition. The upper seat 215 is then lowered into the movable actuator sleeve 230 until the split ring 274 is aligned with the groove 275 in the movable actuator sleeve 230. At this point, the split ring 274 is slid out into the groove 275 inside of the movable actuator sleeve 230 and locked in place by the installation of the ring 273 behind the split ring 274. The seal 270, the retainer 261, the alignment pin 260, and the seal nut 279 are then installed.

In general, fluid flow between the upper seat 215 and the lower seat 220 may be controlled via alignment of the fluid channels 244 of the rotating disk 240 with the fluid channels 222 of the upper seat 215 and the lower seat 220. For example, when the fluid channels 244 of the rotating disk are rotated approximately 90 degrees as compared to the fluid channels 222 of the upper seat 215 and the lower seat 220, the fluid channels 222 of the upper seat 215 and the lower seat 220 abut, to create a seal, on the metal surface of the rotating disk 240, as shown in FIG. 5B, for example, as described in more detail below. Under these conditions, the rotary valve assembly 110 is in the closed position and fluid flow through the upper seat 215 and the lower seat 220 will not occur. On the other hand, if the fluid channels 244 are aligned with the fluid channels 222 of the upper seat 215 and the lower seat 220, the rotary valve assembly 110 is in the open position, and fluid flow through the upper seat 215 and the lower seat 220 will occur.

To create the seal between the upper seat 215 to the rotating disk 240 and between the lower seat 220 and the rotating disk 240, the contacting faces are extremely smooth and flat. This smooth and flat surface is what creates the seal between the rotating disk 240 and the upper seat 215 or the lower seat 220. For example, when pressure comes from below the valve 110 and the rotating disk 240 is in the closed position, the pressure in the flow passage 222 will urge the rotating disk 240 towards the upper seat 215 with enough force to create a seal. Belleville springs 280 are located below the lower seat 220 and above the upper seat 215 to ensure that the rotating disk 240 is always in contact with the upper seat 215 and the lower seat 220.

Figure 2B:
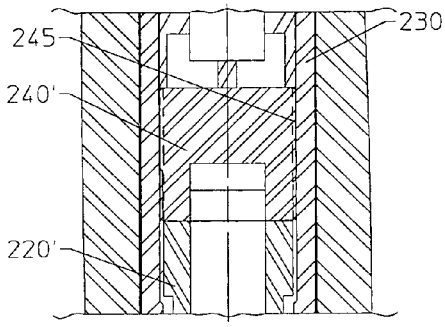
FIG. 2B schematically illustrates a sectional view of a rotary valve assembly in the closed position with the depicted components positioned within a valve body.
Figure 2B:
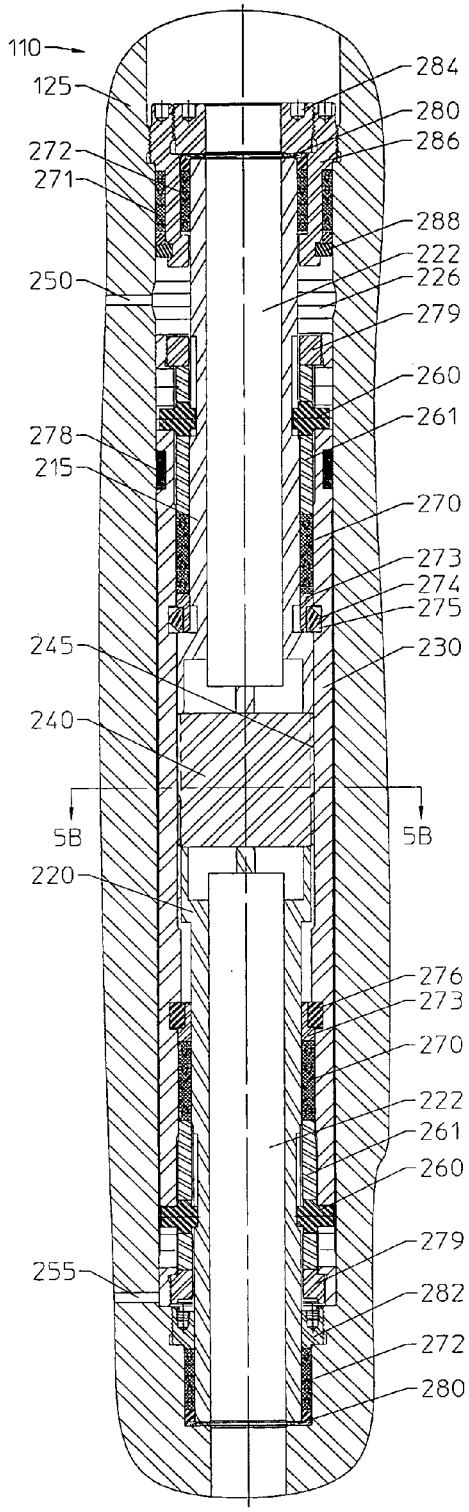
Figure 5A:
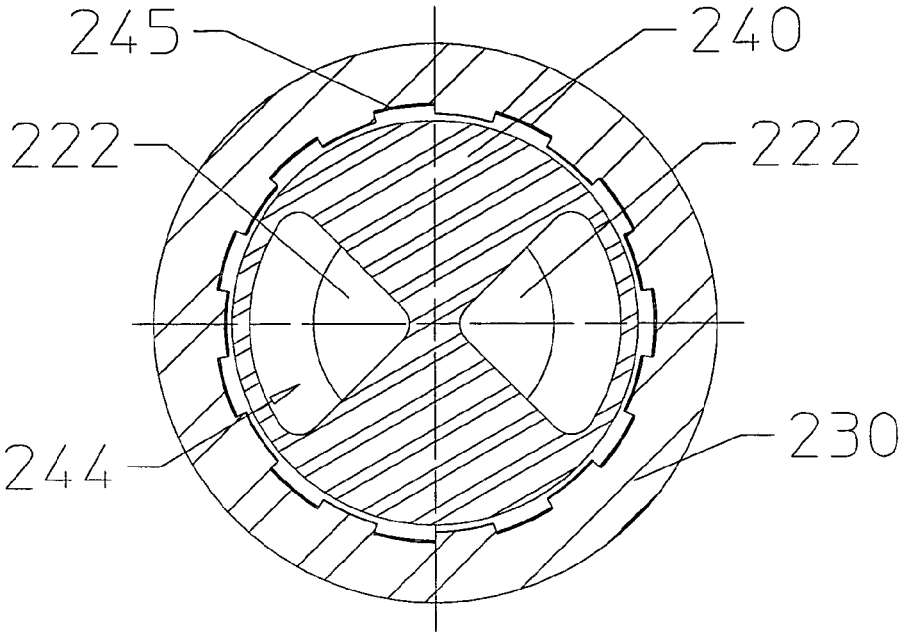
FIG. 5A schematically illustrates a sectional view (taken along line 5A—5A of FIG. 2A) of a disk in the open position.
Figure 5B:
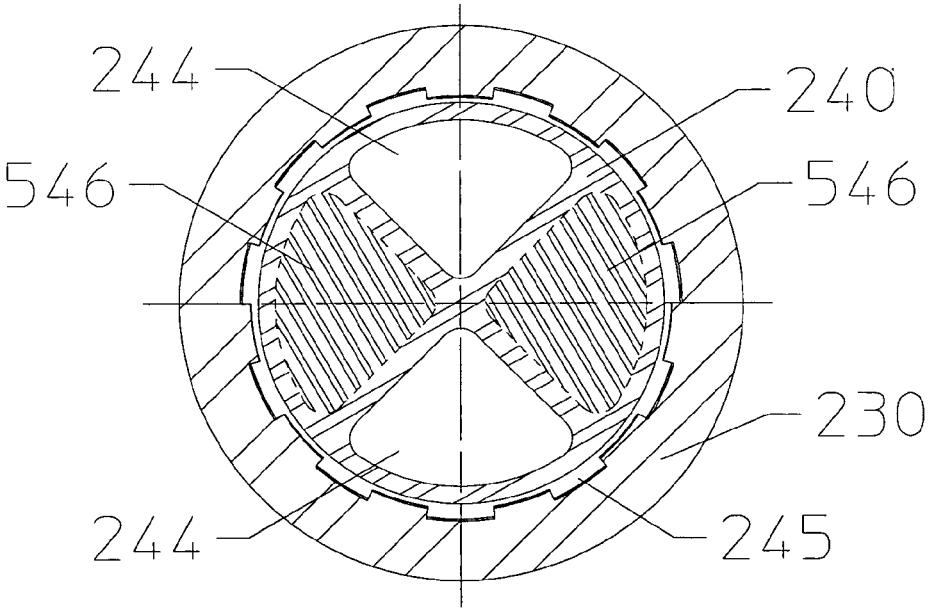
FIG. 5B schematically illustrates a sectional view (taken along line 5B—5B of FIG. 2B) of a disk in the closed position.

A cross-sectional view of the rotating disk 240 in the open position (taken along line 5A—5A of FIG. 2A) is shown generally in FIG. 5A. In the open position, the fluid channels 222 align with the fluid channels 244, thereby permitting fluid flow through the fluid channels 222 of the upper seat 215 and the lower seat 220 and the fluid channels 244 of the rotating disk 240. The movable actuator sleeve 230 is also shown in FIG. 5A. Turning to FIG. 2B, a longitudinal section of the rotary valve assembly 110 in the closed position can be seen. A cross-sectional view of the rotating disk 240 in the closed position (taken along line 5B—5B of FIG. 2B) is shown generally in FIG. 5B. The movable actuator sleeve 230 is also shown in FIG. 5B. FIG. 5B shows the fluid channels 244 and hatched areas 546 denote the positions of the fluid channels 222 of the upper seat 215 or the lower seat 220 relative to the fluid channels 244 of the rotating disk 240 when the rotary valve assembly 110 is in the closed position. In this condition, a seal is formed at the interfaces of the hatched areas 546, thereby preventing fluid flow through the upper seat 215 and the lower seat 220.

Turning back to FIGS. 2A and 2B, a more detailed description of the operation of various illustrative embodiments of the rotary valve assembly 110 may be given. To open the rotary valve assembly 110, hydraulic pressure may be applied, through the pressure port 250, for example, to a top portion of the movable actuator sleeve 230 to drive the movable actuator sleeve 230 downward. The downward movement of the movable actuator sleeve 230 causes the rotating disk 240 to rotate about 90 degrees with respect to the upper seat 215 and/or the lower seat 220, and, thereby align the fluid channels 244 in the rotating disk 240 with the fluid channels 222 of the upper seat 215 and the lower seat 220, opening the rotary valve assembly 110. To close the rotary valve assembly 110, hydraulic pressure may be applied, through the pressure port 255, for example, to a bottom portion of the movable actuator sleeve 230 to drive the movable actuator sleeve 230 upward. The upward movement of the movable actuator sleeve 230 causes the rotating disk 240 to rotate back about 90 degrees with respect to the upper seat 215 and/or the lower seat 220, and, thereby dealign the fluid channels 244 in the rotating disk 240 with the fluid channels 222 of the upper seat 215 and the lower seat 220, closing the rotary valve assembly 110.

In various illustrative embodiments, the rotating disk 240 rotates only in response to a pressure gradient, between the pressure port 250 and the pressure port 255, for example, and removal of the pressure has no effect on the rotary valve assembly 110. Applying hydraulic pressure to the other pressure port, for example, the pressure port 255, may results in the rotating disk 240 rotating to another position. The rotary valve assembly 110 described in various illustrative embodiments may be a "fail-as-is" design, for example, whereby the system maintains its state following a failure and/or a removal of hydraulic pressure. The rotary valve assembly 110 may maintain its state (for example, either open or closed) until the hydraulic pressure is reversed.

As shown in FIG. 3A, the rotating disk 240 may be rotated by the external helical male thread 342, located on an outer diameter surface of the rotating disk 240, which engages into the mating female thread 245 located on an inner diameter surface of the movable actuator sleeve 230. In various alternative illustrative embodiments, as shown generally in FIG. 6A, for example, an upper rotating disk portion 680 may be held in orientation with a movable actuator sleeve 630 by alignment pins 686 that run in helical grooves 685 in the upper rotating disk portion 680. The upper rotating disk portion 680 may be rotated by the alignment pins 686 that are disposed in holes on the inside diameter of the movable actuator sleeve 630 at the outer ends of the alignment pins 686 and engage into the helical grooves 685 (see, for example, FIGS. 7A–7D) located on the outside diameter of the upper rotating disk portion 680 with the inner ends of the alignment pins 686. These various alternative illustrative embodiments require a two-piece rotating disk, comprising the upper rotating disk portion 680 and a lower rotating disk portion 681, to allow for the assembly of the alignment pins 686.

Figure 6A:
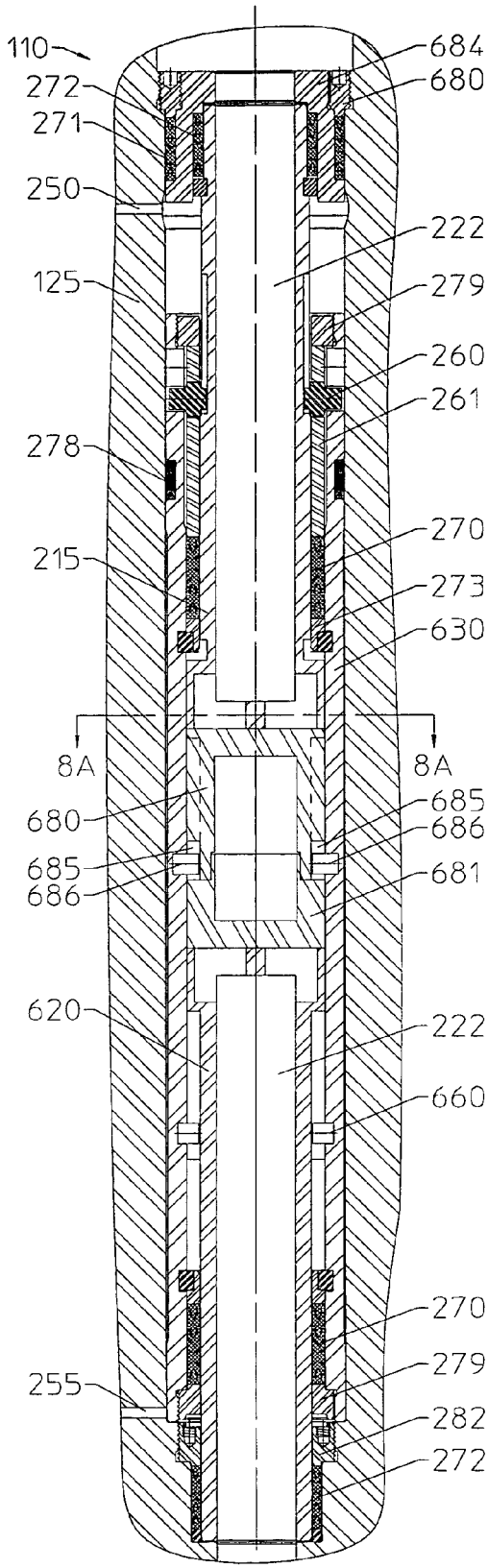
FIG. 6A schematically illustrates a sectional view of an alternate example of a split disk rotary valve assembly in the closed position with the depicted components positioned within a valve body.
Figure 6B:
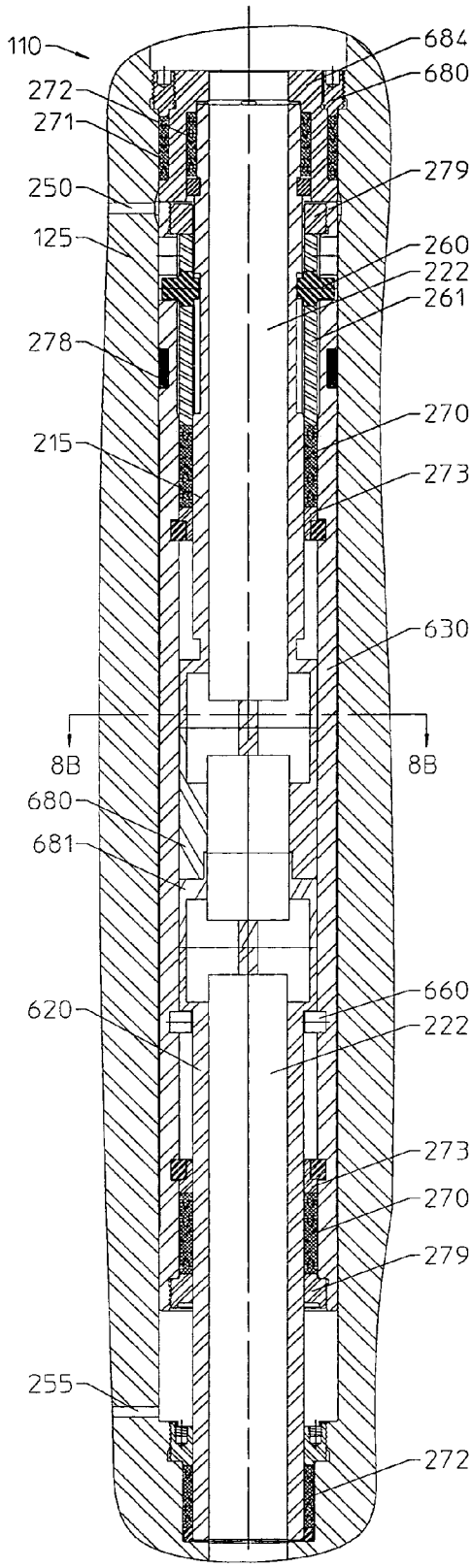
FIG. 6B schematically illustrates a sectional view of an alternate example of a split disk rotary valve assembly in the open position with the depicted components positioned within a valve body.

FIGS. 6A and 6B show various alternative illustrative embodiments that use the alignment pins 686 to control the movement of the upper rotating disk portion 680. The components shown in FIGS. 6A and 6B are similar to those shown in FIGS. 2A and 2B except for packing retainer 684, packing retainer 680, lower seat 620, alignment pin 660, the upper rotating disk portion 680, the lower rotating disk portion 681, pin 892 (see FIGS. 8E and 8F, for example), and spring 890 (see FIGS. 8E and 8F, for example). The components in FIGS. 6A and 6B that are not similar to the components in FIGS. 2A and 2B, although they are of slightly different configuration than those described in FIGS. 2A and 2B, function in a similar manner to their respective corresponding components in FIGS. 2A and 2B.

Figure 7A:
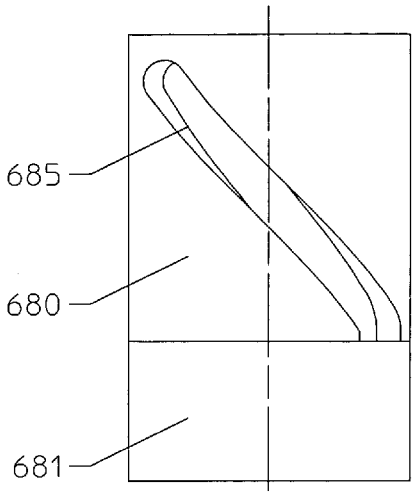
FIG. 7A schematically illustrates the side view of upper and lower split rotating disk portions with an example groove in the upper rotating disk portion.
Figure 7B:
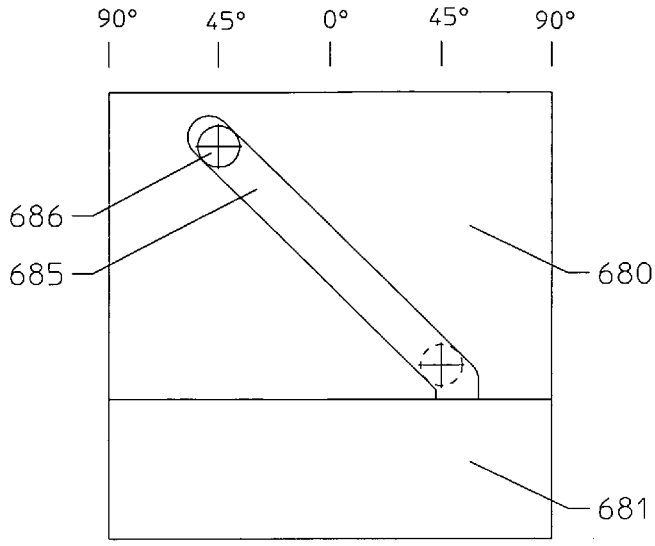
FIG. 7B schematically illustrates the rotational pattern of the upper and lower split disks as a pin traverses across the groove shown in FIG. 7A.
Figure 7C:
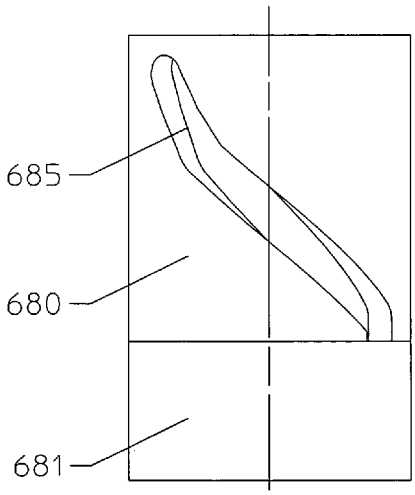
FIG. 7C schematically illustrates the side view of the upper and lower split rotating disk portions with an alternate example groove in the upper rotating disk portion.
Figure 7D:
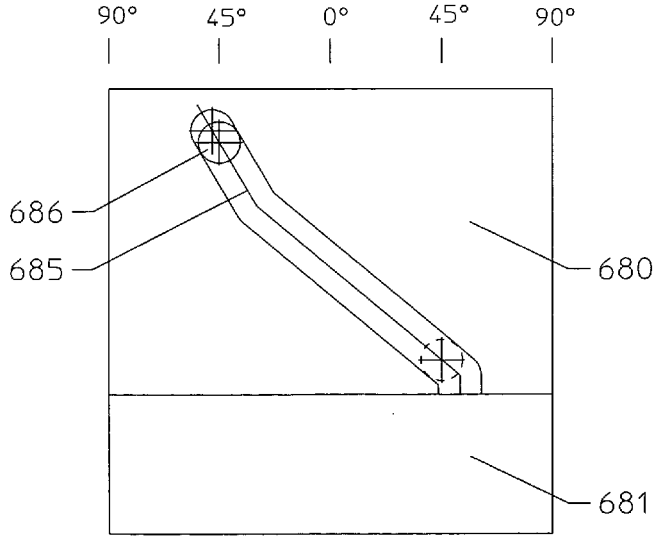
FIG. 7D schematically illustrates the rotational pattern of an alternate split disk as a pin traverses across the groove shown in FIG. 7C.

The outer end of the alignment pin 686 is connected to the movable actuator sleeve 630, and the inner end of the alignment pin 686 is disposed in the helical groove 685 disposed in the upper rotating disk portion 680. The upper rotating disk portion 680 is disposed on the lower rotating disk portion 681. FIG. 6A is a sectional view of the rotary valve assembly 110 with the upper rotating disk portion 680 in the closed position. FIG. 6B is a sectional view of rotary valve assembly 110 with both rotating disk portions 680 and 681 in the open position. The alignment pins 686 are not shown in FIG. 6B because those alignment pins 686 are orthogonal to the sectional plane shown in FIG. 6B. As shown in FIGS. 7A–7D, the upper rotating disk portion 680 includes the helical grooves 685 through which the alignment pins 686 may travel. The lower rotating disk portion 681 is also shown in FIGS. 7A–7D. Hydraulic pressure created by hydraulic fluid entering the pressure port 250 causes the movable actuator sleeve 630 to move. Movement of the movable actuator sleeve 630 causes the alignment pins 686 to move thorough the helical grooves 685. As the alignment pins 686 move through the helical grooves 685, the upper rotating disk portion 680 and the lower rotating disk portion 681 rotate. FIGS. 7A and 7C show two different implementations of the helical grooves 685. FIGS. 7B and 7D show the corresponding rotation patterns of each upper rotating disk portion 680 as a function of the alignment pin 686 traversal through the respective helical grooves 685.

Figure 8A:
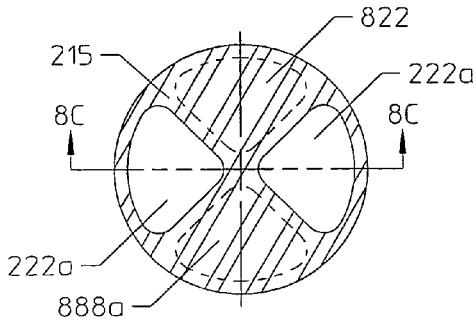
FIGS. 8A and 8B schematically illustrate sectional views of the upper seat with the upper and lower split rotating disk portions in the closed and open positions taken along line 8A—8A and 8B—8B in FIGS. 6A and 6B, respectively.
Figure 8B:
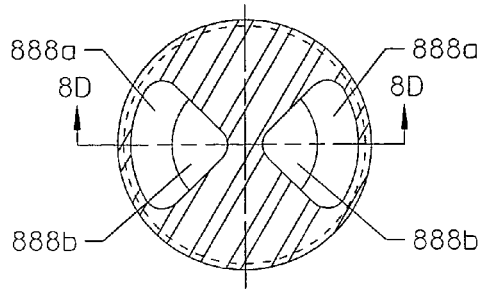

FIG. 8A is a cross-section, taken along line 8A—8A of FIG. 6A, of the upper seat 215. End views of fluid channels 888*a* and 888*b* of the upper rotating disk portion 680 are shown in FIG. 8B. As shown in FIGS. 8B and 8D, the fluid channel 888 includes two substantially triangular or two substantially pie-shaped regions 888*a*, to maximize the flow area, and a central region 888*b*. In various alternative illustrative embodiments, the fluid channel 888 may include one or more substantially round or other appropriately shaped fluid channels 888*a*. Regions 822, shown in phantom in FIG. 8A, denote the regions 888*a* of the upper rotating disk portion 680 that are adjacent to the upper seat 215 when the rotary valve assembly 110 is in the closed position. As described above, when the fluid channels 888 and 222 are rotated approximately 90 degrees with respect to each other, the rotary valve assembly 110 is in the closed or sealed off position. The rotary valve assembly 110 in the open position is shown in FIG. 8B (the cross-section taken along line 8B—8B of FIG. 6B). Here, the fluid channels 888*a* and 888*b* and 222 are aligned with respect to each other, thereby permitting fluid to flow between the lower seat 620 and the upper seat 215.

Figure 8C:
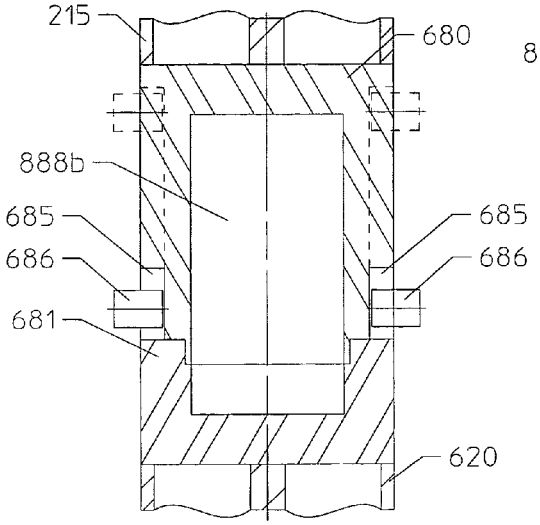
FIG. 8C schematically illustrates a view taken along line 8C—8C in FIG. 8A.
Figure 8D:
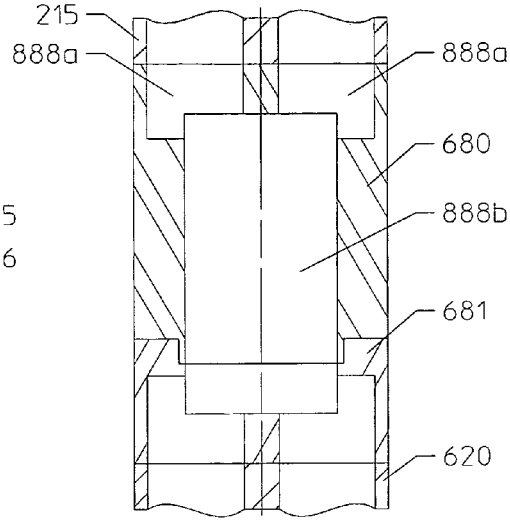
FIG. 8D schematically illustrates a sectional view taken along line 8D—8D in FIG. 8B.

FIG. 8C is a longitudinal section of the upper rotating disk portion 680, the lower rotating disk portion 681, the bottom portion of the upper seat 215, and the top portion of the lower seat 620, taken along line 8C—8C of FIG. 8A, illustrating the rotary valve assembly 110 in the closed position. Also shown in FIG. 8C is the alignment pin 686, the helical groove 685, and the lower rotating disk portion 681. Turning to FIG. 8D, a longitudinal section of FIG. 8B (taken along line 8D—8D of FIG. 8B) is shown, illustrating the rotary valve assembly 110 in the open position, along with the lower rotating disk portion 681, the upper rotating disk portion 680, the bottom portion of the upper seat 215, and the top portion of the lower seat 620.

Figure 8E:
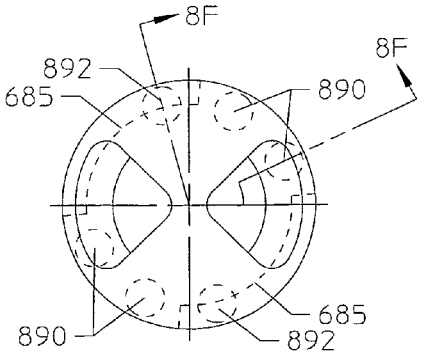
FIG. 8E schematically illustrates a bottom view of FIG. 8D, showing locations of chambers for springs 890, pins 892, and the outer diameter grooves (shown in phantom)

FIG. 8E is a bottom view of the lower rotating disk portion 681, showing various illustrative embodiments of the upper rotating disk portion 680. In various illustrative embodiments, the upper rotating disk portion 680 may include an upper section and a lower section and may show locations of cavities for one or more alignment pins 892 and/or springs 890 (see, for example, FIG. 8F). The spring 890 cavity positions in the upper rotating disk portion 680 are shown in phantom in FIG. 8E, and the alignment pin 892 cavities are shown in phantom in FIG. 8E. Also shown in phantom in FIG. 8E are the helical grooves 685 in which the alignment pins 686 traverse.

Figure 8F:
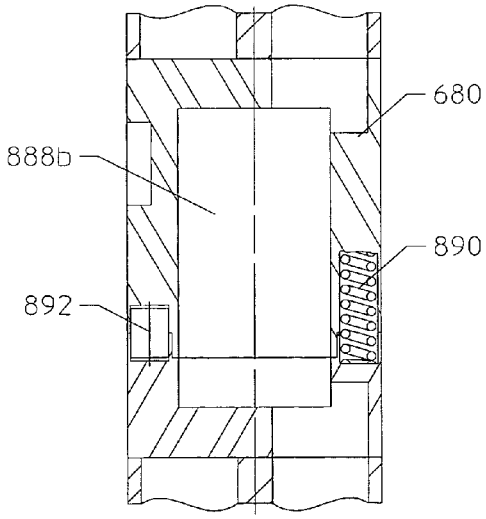
FIG. 8F schematically illustrates a sectional view of the upper and lower split seats taken along line 8F—8F in FIG. 8E.

FIG. 8F is a longitudinal section of the upper rotating disk portion 680, the lower rotating disk portion 681, the bottom portion of the upper seat 215, and the top portion of the lower seat 620, taken along line 8F—8F of FIG. 8E. FIG. 8F shows the alignment pin 892 and the spring 890. The alignment pin 892 keeps the upper rotating disk portion 680 aligned with the lower rotation disk portion 681. The spring 890 keeps the upper rotating disk portion 680 in contact with the upper seat 215 and keeps the lower rotation disk portion 680 in contact with the lower seat 620. The spring 890 allows for the elimination of the spring 280 shown in FIGS. 2A and 2B, for example, in these alternative illustrative embodiments.

Those skilled in the art having the benefit of the present disclosure will appreciate that, in various illustrative embodiments, all the components depicted in FIGS. 2A, 2B, 6A, and/or 6B may be contained within the body of the rotary valve assembly 110, which would be the case if the components were installed within the body of the rotary valve assembly 110 including a tubing hanger for suspending tubing string in a well. The configuration of the body of the rotary valve assembly 110 itself may differ depending on the application. The rotary valve assembly 110 according to various illustrative embodiments of the present invention is particularly designed, however, for operation within a fluid stream wherein a seat ring seals with the closed rotating disk 240 and/or the closed upper rotating disk portion 680 and/or the closed lower rotating disk portion 681 when fluid pressure is either upstream or downstream of the rotating disk 240 or below the upper rotating disk portion 680 or above the lower rotating disk portion 681.

As briefly discussed above, the rotating disk 240 and/or the upper rotating disk portion 680 with the lower rotating disk portion 681 movement is controlled by axial movement of the movable actuator sleeve 230 and/or the movable actuator sleeve 630, which is accomplished by the introduction of fluid pressure in the pressure port 250 and/or the pressure port 255. Those skilled in the art having the benefit of the present disclosure will appreciate that various porting arrangements may be used for providing fluid pressure to the movable actuator sleeve 230 and/or the movable actuator sleeve 630, which will shift the movable actuator sleeve 230 and/or the movable actuator sleeve 630 axially and rotate the rotating disk 240 and/or the upper rotating disk portion 680 with the lower rotating disk portion 681. If desired, movement of the movable actuator sleeve 230 and/or the movable actuator sleeve 630 in one direction, for example, in the rotary valve assembly 110 closed direction, may be accomplished by a biasing spring (not shown), so that fluid pressure overcomes this biasing force to open the rotary valve assembly 110.

The rotary valve assembly 110 may be provided with a spring located in the cavity 224 shown in FIG. 2A or in the cavity 226 shown in FIG. 2B and/or other biasing member (not shown) for mechanically biasing the movable actuator sleeve 230 and/or the movable actuator sleeve 630 in one axial position, making the rotary valve assembly 110 a fail-safe open or fail-safe closed design, as may be appropriate and/or desirable. This biasing force alone and/or in conjunction with hydraulic pressure may be used to shift the rotary valve assembly 110 in one position, with hydraulic pressure then being used to shift the rotary valve assembly 110 in the opposing position. A spring may thus bias the movable actuator sleeve 230 and/or the movable actuator sleeve 630 so that the rotating disk 240 and/or the upper rotating disk portion 680 with the lower rotating disk portion 681 is normally closed, and the rotating disk 240 and/or the upper rotating disk portion 680 with the lower rotating disk portion 681 is opened only in response to hydraulic pressure applied to an open rotary valve assembly 110 hydraulic port, for example, the pressure port 250 or the pressure port 255, as appropriate.

The body of the rotary valve assembly 110 as discussed above may be disposed in the tubing hanger body 125 designed to support the tubing string 180 in a well. Besides controlling completion fluid in a tubing hanger, various illustrative embodiments of the present invention have utility when used with other oil and gas production equipment, including downhole safety valves and surface valves, each having a valve body, and/or to multiple valve systems, such as manifolds, which may use a unitary block housing multiple disk, and/or manifolds wherein one or more of the valve bodies are interconnected structurally and fluidly so that the system acts as a manifold. As those of ordinary skill in the art having the benefit of the present disclosure will recognize, various illustrative embodiments of the present invention also have applications outside of the oil and gas field. One such application is the use of these valves as chemical injection valves.

The foregoing disclosure and description of the present invention is illustrative and explanatory of preferred embodiments. It would be appreciated by those skilled in the art having the benefit of the present disclosure that various changes in the size, shape of materials, as well in the details of the illustrated construction or combination of features discussed herein maybe made without departing from the spirit of the invention, which is defined by the following claims.

This present invention may be applied in various applications. For example, the rotary valve assembly 110 may be used to control completion fluid in a tubing hanger. The rotary valve assembly 110 may also be used to control fluids in a manifold. One such example fluid is production fluid. Additionally, the rotary valve assembly 110 may be used in chemical injection valves.

Therefore, the various illustrative embodiments of the present invention enabled and described herein are well adapted to carry out the objects and attain the ends and advantages mentioned, as well as those that are inherent therein. While the present invention has been depicted, described, and defined by reference to exemplary embodiments of the present invention, such a reference does not imply any limitation of the present invention, and no such limitation is to be inferred. The present invention is capable of considerable modification, alteration, and equivalency in form and function as will occur to those of ordinary skill in the pertinent arts having the benefit of this disclosure. The depicted and described illustrative embodiments of the present invention are exemplary only and are not exhaustive of the scope of the present invention. Consequently, the present invention is intended to be limited only by the spirit and scope of the appended claims, giving full cognizance to equivalents in all respects.

The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. In particular, every range of values (of the form, "from about a to about b," or, equivalently, "from approximately a to b," or, equivalently, "from approximately a–b") disclosed herein is to be understood as referring to the power set (the set of all subsets) of the respective range of values, in the sense of Georg Cantor. Accordingly, the protection sought herein is as set forth in the claims below.

What is claimed is:

1. A valve assembly, comprising:

at least one seat, the at least one seat having at least one fluid channel capable of providing fluid flow therethrough;

a movable actuator sleeve movable in response to hydraulic pressure, the movable actuator sleeve disposed about the at least one seat; and a rotating disk disposed between the at least one seat and a support bushing, the rotating disk capable of rotating in response to movement of the movable actuator sleeve, the rotating disk having an open position and a closed position, wherein the open position permits fluid flow through the at least one fluid channel of the at least one seat and the closed position stops fluid flow through the at least one fluid channel of the at least one seat.

2. The valve assembly of claim 1, further comprising:

a plurality of orientation pins defining a static orientation between the at least one seat and the support bushing.

3. The valve assembly of claim 1, further comprising at least one of:

an external helical male thread disposed on an outer diameter surface of the rotating disk and a mating female thread disposed on an inner diameter surface of the movable actuator sleeve, wherein the rotating disk is capable of being rotated by the external helical male thread engaging into the mating female thread in response to movement of the movable actuator sleeve; and a plurality of alignment pins defining a first position of the rotating disk to the at least one seat when the rotating disk is in the open position and a second position of the rotating disk to the at least one seat when the rotating disk is in the closed position.

4. The valve assembly of claim 1, further comprising:

a spring for preloading the rotating disk for sealing to the at least one seat.

5. The valve assembly of claim 1, wherein the rotating disk comprises at least one fluid channel.

6. The valve assembly of claim 1, wherein the rotating disk comprises at least one of two substantially triangular fluid channels, two substantially pie-shaped fluid channels, and two substantially round fluid channels.

7. The valve assembly of claim 1, wherein the rotating disk comprises two substantially pie-shaped fluid channels.

8. The valve assembly of claim 1, wherein the at least one seat comprises at least one fluid channel.

9. The valve assembly of claim 1, wherein the at least one seat comprises at least one of two substantially triangular fluid channels, two substantially pie-shaped fluid channels, and two substantially round fluid channels.

10. The valve assembly of claim 1, wherein the at least one seat comprises two substantially pie-shaped fluid channels.

11. A rotary valve assembly, comprising:

a first seat and a second seat, the first seat and the second seat each having a fluid channel capable of providing fluid flow therethrough;

a movable actuator sleeve movable in response to hydraulic pressure, the movable actuator sleeve disposed about the first seat and the second seat; and a rotating disk disposed between the first seat and the second seat, the rotating disk capable of rotating in response to movement of the movable actuator sleeve, the rotating disk having an open position and a closed position, wherein the open position permits fluid flow between the fluid channels of the first seat and the second seat and the closed position stops fluid flow between the fluid channels of the first seat and the second seat.

12. The rotary valve assembly of claim 11, further comprising:

a plurality of orientation pins defining a static orientation between the first seat and the second seat.

13. The rotary valve assembly of claim 1, further comprising:

an external helical male thread disposed on an outer diameter surface of the rotating disk and a mating female thread disposed on an inner diameter surface of the movable actuator sleeve, wherein the rotating disk is capable of being rotated by the external helical male thread engaging into the mating female thread in response to movement of the movable actuator sleeve; and a plurality of alignment pins defining a first position of the rotating disk to the first seat and the second seat when the rotating disk is in the open position and a second position of the rotating disk to the first seat and the second seat when the rotating disk is in the closed position.

14. The rotary valve assembly of claim 11, further comprising:

a spring for preloading the rotating disk for sealing to at least one of the first seat and the second seat.

15. The rotary valve assembly of claim 11, wherein the rotating disk comprises a plurality of fluid channels.

16. The rotary valve assembly of claim 11, wherein the rotating disk comprises at least one of two substantially triangular fluid channels, two substantially pie-shaped fluid channels, and two substantially round fluid channels.

17. The rotary valve assembly of claim 11, wherein the first seat and the second seat each comprise a plurality of fluid channels.

18. The rotary valve assembly of claim 11, wherein the first seat and the second seat each comprise at least one of two substantially triangular fluid channels, two substantially pie-shaped fluid channels, and two substantially round fluid channels.

19. The rotary valve assembly of claim 11, wherein the rotating disk, the first seat, and the second seat each comprise two substantially pie-shaped fluid channels.

20. A rotary valve assembly, comprising:

a first seat and a second seat, the first seat and the second seat each having a fluid channel capable of providing fluid flow therethrough;

a movable actuator sleeve movable in response to hydraulic pressure, the movable actuator sleeve disposed about the first seat and the second seat; and rotating disk means disposed between the first seat and the second seat, the rotating disk means capable of rotating in response to movement of the movable actuator sleeve means, the rotating disk means having an open position and a closed position, wherein the open position permits fluid flow between the fluid channels of the first seat and the second seat and the closed position stops fluid flow between the fluid channels of the first seat and the second seat.

* * * * *